US006543729B1

(12) United States Patent
Ylonen

(10) Patent No.: US 6,543,729 B1
(45) Date of Patent: Apr. 8, 2003

(54) EVESTROUGH HANGER BRACKET

(75) Inventor: Heikki Ylonen, Concord (CA)

(73) Assignee: Royal Group Technologies Limited, Woodbridge (CA)

( * ) Notice: Subject to any disclaimer, the term of this patent is extended or adjusted under 35 U.S.C. 154(b) by 0 days.

(21) Appl. No.: 10/172,023

(22) Filed: Jun. 17, 2002

(51) Int. Cl.[7] ..... E04D 13/064; E04D 13/00; E04D 13/072

(52) U.S. Cl. ..... 248/48.1; 248/48.2; 52/11; 52/713; 52/714; 52/715

(58) Field of Search ..... 248/48.1, 48.2, 248/71, 216.1, 547; 52/11, 12, 15, 713, 714, 715, 94

(56) References Cited

U.S. PATENT DOCUMENTS

| | | | | | |
|---|---|---|---|---|---|
| 1,855,241 | A | * | 4/1932 | Irwin | 248/48.2 |
| 2,761,642 | A | * | 9/1956 | Rachlin | 248/48.1 |
| 3,053,491 | A | * | 9/1962 | Ramser | 248/48.2 |
| 3,296,749 | A | * | 1/1967 | Cotter | 52/11 |
| 3,341,158 | A | * | 9/1967 | Landis | 248/48.2 |
| 3,344,566 | A | * | 10/1967 | Miles et al. | 52/94 |
| 3,416,760 | A | * | 12/1968 | Sauder | 248/48.2 |
| 3,426,987 | A | * | 2/1969 | Leslie | 248/48.2 |
| 3,737,127 | A | * | 6/1973 | Maloney et al. | 248/48.2 |
| 3,752,428 | A | * | 8/1973 | Trostle et al. | 248/48.2 |
| 3,809,347 | A | * | 5/1974 | Pekarek | 248/48.1 |
| 4,169,570 | A | * | 10/1979 | Morin | 248/48.2 |
| 4,210,301 | A | * | 7/1980 | Weiss | 248/48.2 |
| 4,241,548 | A | * | 12/1980 | Rowe | 52/11 |
| 4,294,422 | A | * | 10/1981 | Odekirk | 248/48.2 |
| 4,910,926 | A | * | 3/1990 | Paulsson | 52/11 |
| D314,815 | S | * | 2/1991 | Paulsson | D23/267 |
| 5,004,191 | A | * | 4/1991 | Corry | 248/48.2 |
| 5,271,192 | A | * | 12/1993 | Nothum et al. | 52/12 |
| 5,388,377 | A | * | 2/1995 | Faulkner | 52/11 |
| D383,966 | S | * | 9/1997 | Zaccagni | D8/354 |
| 5,884,876 | A | * | 3/1999 | Axford | 248/48.2 |
| 6,209,826 | B1 | * | 4/2001 | Pratt, Jr. | 248/48.2 |
| 6,254,039 | B1 | * | 7/2001 | Zimmerman | 248/48.2 |

FOREIGN PATENT DOCUMENTS

| | | | |
|---|---|---|---|
| JP | 4155053 | A | * 5/1992 |
| JP | 5148964 | A | * 6/1993 |
| JP | 5311826 | A | * 11/1993 |

* cited by examiner

*Primary Examiner*—Anita King
*Assistant Examiner*—Naschica S. Morrison

(57) ABSTRACT

An evestrough hanger bracket has a main bracket member and a separately made secondary bracket member. The main bracket member has front and rear end evestrough clips with the front end clip having a fastener member fitting opening. The secondary bracket member which slideably locks into engagement with the main bracket member has a tubular guide to receive the fastener member in the form of a mounting screw or nail. The guide of the secondary fastener member presents an elongated bore which aligns with and terminates at the opening through the front clip of the main bracket member.

4 Claims, 2 Drawing Sheets

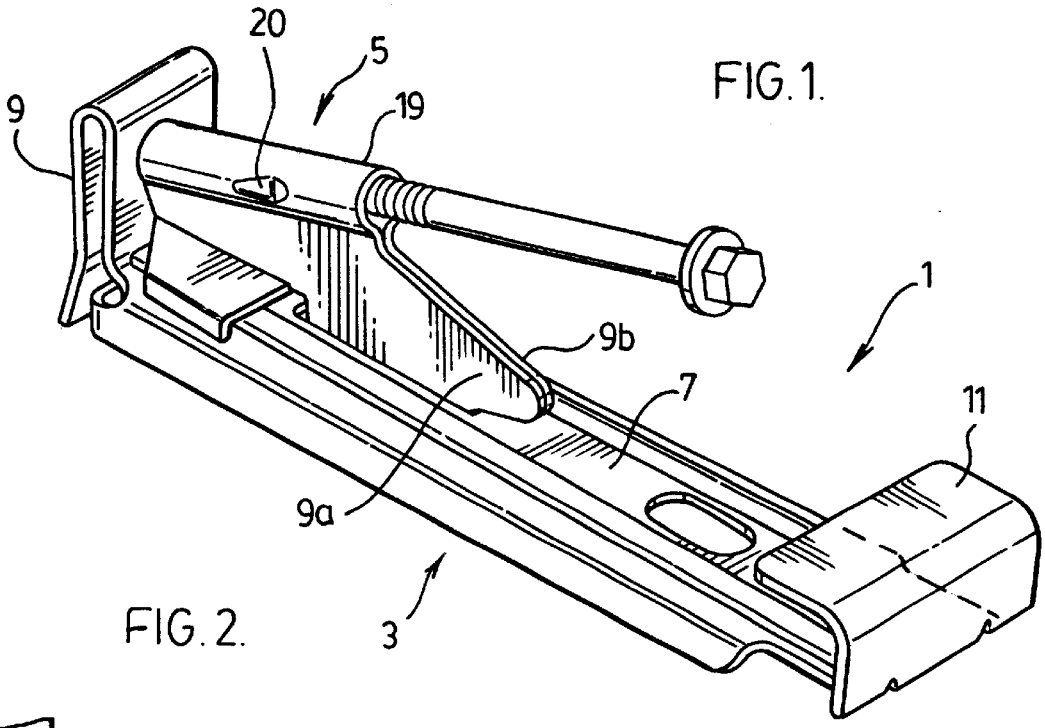
FIG. 1.
FIG. 2.
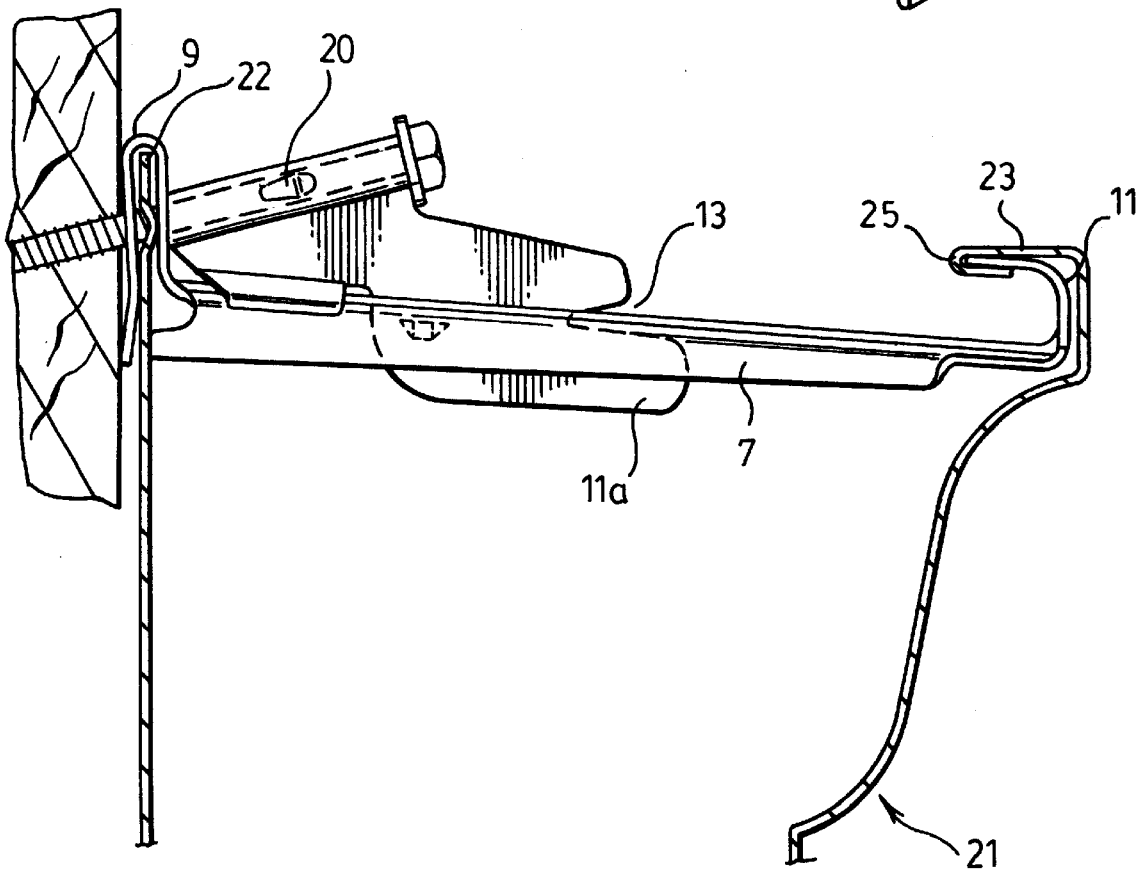

N
S
20
19
5
7b
16a
17a
9b
15a
9a
13
9
13
7a
11b
11a
17
15
19'
19a
7
11

EVESTROUGH HANGER BRACKET

FIELD OF THE INVENTION

The present invention relates to an evestrough hanger bracket of the type which is made of two separate pieces that interlock with one another when the bracket is assembled.

BACKGROUND OF THE INVENTION

There are many different designs for evestrough hanger brackets. A number of these designs comprise a single piece construction.

Evestrough hanger brackets have a host of different functioning parts. They must have a front part to engage one side of the evestrough, a rear part to engage the other side of the evestrough and a further nail or screw receiving part. Accordingly, an evestrough hanger bracket is relatively complicated in its construction making it very difficult to produce the bracket from a single piece of blank material. As a result, there has been a trend towards multiple piece hanger brackets. When working with multiple pieces some of the functioning parts of the bracket can be provided on one piece and other working parts of the bracket can be provided on a totally separate piece. The pieces are then put together with one another to provide the overall hanger bracket.

When working with a multiple piece bracket it is important that the individual pieces be easily and reliably secured to one another. As an added benefit they should also be readily broken apart from one another should any of the pieces become damaged with use of the bracket. If they can be readily disassembled then only the damaged part needs to be replaced.

SUMMARY OF THE PRESENT INVENTION

The present invention provides an evestrough hanger bracket which has a two piece construction so that it does not face problems associated with a single complicated construction bracket. Furthermore, according to the present invention the two pieces of the hanger bracket are easily both assembled and broken apart from one another adding further to the benefits of the bracket.

More particularly, the evestrough hanger bracket of the present invention comprises a main bracket member and a secondary bracket member. The main bracket member has front and rear end evestrough engagement clips. The front end clip opens downwardly and the rear end clip opens forwardly towards the front end clip. These two clips provide a simple and efficient engagement with the evestrough.

The front end clip of the main bracket member has an opening to fit a fastener member e.g., a screw or a nail through the front end clip. The secondary bracket member slides into locking engagement with the main bracket member and has a tubular fastener member guide. This guide abuts with and extends rearwardly from the front end clip of the main bracket member when the two bracket members interlock with one another.

BRIEF DESCRIPTION OF THE DRAWINGS

The above as well as other advantages and features of the present invention will be described in greater detail according to the preferred embodiments of the present invention in which;

FIG. 1 is a perspective view looking down on an evestrough hanger bracket according to a preferred embodiment of the present invention;

FIG. 2 is a side view of an evestrough when mounted to a building using the evestrough hanger bracket of FIG. 1.

Figure 3:
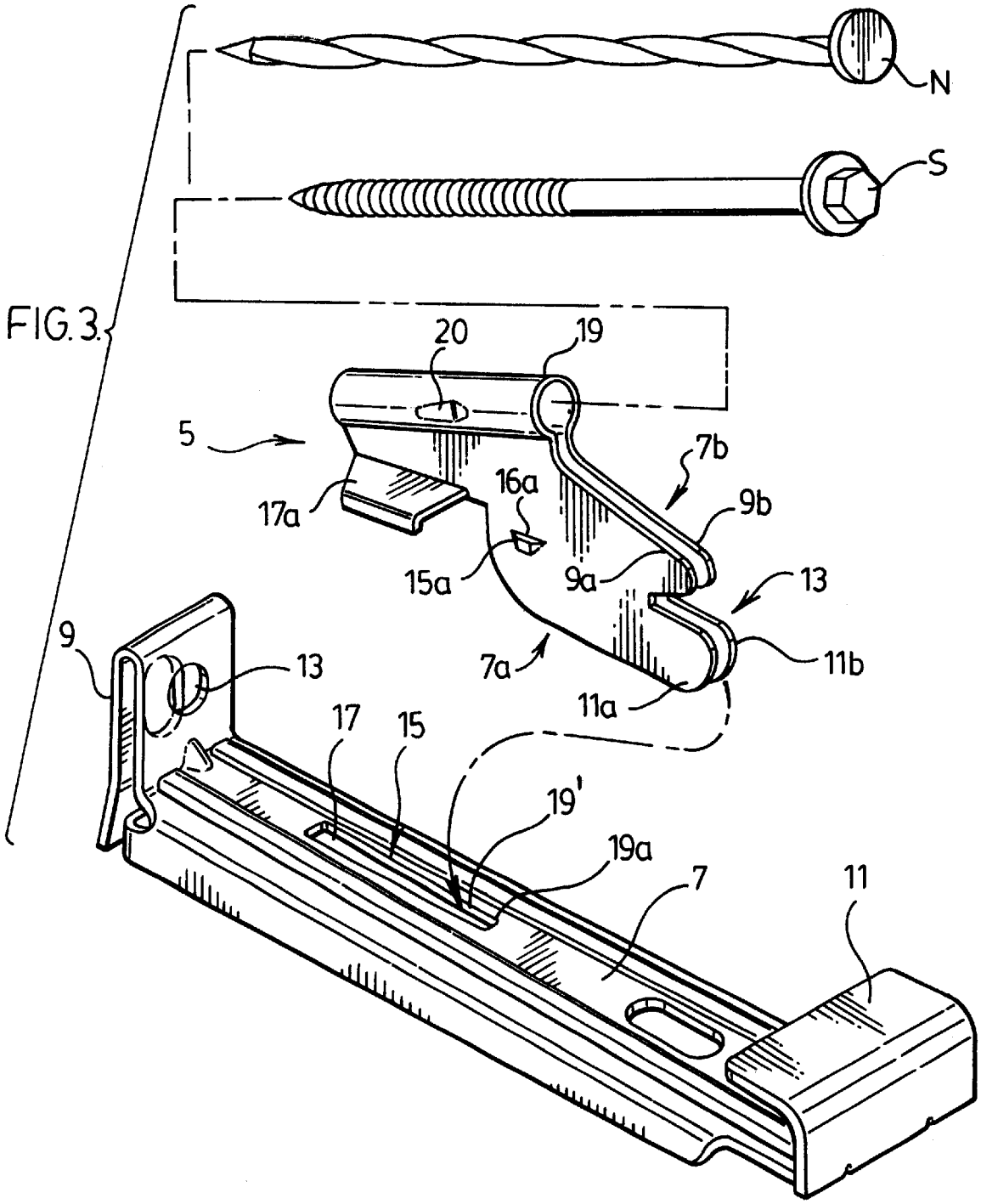
FIG. 3 is an exploded perspective view of the evestrough hanger bracket of FIG. 1.

DETAILED DESCRIPTION ACCORDING TO THE PREFERRED EMBODIMENTS OF THE PRESENT INVENTION IN WHICH

FIG. 1 shows an evestrough hanger bracket generally indicated at 1. This bracket comprises a main bracket member generally indicated at 3 and a secondary bracket member generally indicated at 5.

As best seen in FIG. 3 of the drawings these two bracket members are made separately from one another and then interlocked to form the overall bracket.

FIG. 2 of the drawings shows an evestrough generally indicated at 21 when mounted to a building by bracket 1. As will be seen in FIG. 2 the main bracket member 3 comprises an elongated body portion 7 having a downwardly opening clip 9 at one end e.g., the front or interior end of the bracket, and a forwardly opening clip 11 at the other end e.g., the back or outside end of the bracket.

The front end clip 9 has a U shape which slides downwardly over the interior edge 22 of the evestrough. The rear end clip 11 slides forwardly into a small U shaped return 25 at the outer edge 23 of the evestrough.

FIG. 3 shows the front end clip 9 includes an opening 13 through the two walls of the clip. Opening 13 allows a mounting screw S or a mounting nail N as shown in FIG. 3 to pass through the clip. The mounting screw or nail penetrates the edge 22 of the trough to trap the edge of the trough within the clip 9. The mounting member then pierces the mounting surface of a building to which the evestrough is secured as shown in FIG. 2 of the drawings.

Both the main and secondary members of the bracket preferably have a metal construction. The metal in this construction is weather resistant be it through the actual material or the treatment of the material in the bracket.

The secondary bracket member 5 as best shown in FIG. 3 of the drawings is formed from a blank of material having side regions 7*a* and 7*b* which are symmetrical to opposite sides of the secondary bracket member. The secondary bracket member is then bent about the center area of the bracket member to form a hollow tubular guide 19.

Located rearwardly of the hollow tubular guide is 30 a tail region of bracket member 5. This tail region is formed by tail parts 9*a* and 11*a* to one side of the bracket member and tail parts 9*b* and 11*b* to the other side of the bracket member. The tail parts 9*a* and 9*b* are separated from the tail parts 11*a* and 11*b* by a slot or groove generally indicated at 13 in the tail parts.

Tail part 9*a* includes a small radially projecting lug 15*a*. An identical lug is also provided on tail part 9*b* although it cannot be seen in the drawings.

Lug 15*a* slopes downwardly inwardly on tail part 7*a* and has a flat top surface 16*a*. This provides firstly a cammed fitting and then a locking surface of the lug relative to the main bracket member as will be described later in detail.

Provided forwardly of tail parts 9*a* and 11*a* is a wing like projection 17*a*. An identical wing is provided on the other side of the secondary bracket member.

It is to be noted in FIG. 3 when the secondary bracket member is away from the primary bracket member the two tail parts of the secondary bracket member do not close completely against one another. They are maintained, slightly separated until the secondary bracket member is interlocked with the primary bracket member as is also described later in detail.

In order to provide a slide interlock between the two bracket members the body 7 of the main bracket member 3 is provided with an elongated blind ended slot generally indicated at 15. This slot has a wider front slot region 17 and narrower rear slot region 19'.

For purposes of fitting the two bracket members together, bracket member 5 is first tipped upwardly from the FIG. 3 position to a position in which the two tail parts 11*a* and 11*b* face downwardly over the wider slot region 17 of the slot 15 in the main bracket member. The secondary bracket member is then moved downwardly to fit the two tail parts 11*a* and 11*b* through slot 15. At the same time the secondary bracket member is pivoted or rotated back to the FIG. 3 position forcing the lugs on the tail parts of the secondary bracket member to cam down through the wide slot region 17 of the slot 15 in the primary bracket member. As this is occurring the front edge of the guide 19 engages the front end clip 9 of the primary bracket member causing the secondary bracket member to slide rearwardly of the primary bracket member. This produces a plurality of interlocks between the two bracket members.

Firstly, the secondary bracket member continues to be pushed rearwardly of the primary bracket member such that the blind end 19*a* of the narrow slot region slides into the slot or groove 13 of the tail region of the secondary bracket member. In this position the tail parts 9*a* and 9*b* are trapped on the upper surface while the tail parts 11*a* and 11*b* are trapped against the lower surface of the body 7 of the primary bracket member as clearly shown in FIG. 2 of the drawings. Furthermore, the two lugs on each side of the secondary bracket member have also been pushed rearwardly to a position where they are beneath the narrower part of slot 15. The flat upper surfaces of these two lugs seat against the undersurface of the body 7 of the main bracket member. They will not pull back upwardly through the slot until the secondary bracket member is slid in the opposite direction forwardly of the main bracket member. The engagement of the front edge of the guide 19 with the front clip 9 prevents this from happening without deliberately lifting the secondary bracket member.

As earlier described the two tail parts of the secondary bracket member are sprung slightly apart from one another for assembly of the bracket. However, when the two bracket members are fully interlocked with one another it will be seen in FIG. 1 that the tail parts to opposite sides of guide 19 are completely pressed or pinched against one another. This occurs once again as a result of the narrowing or tapering of slot 15 in the primary bracket member. The natural resiliency of the steel material used to make the secondary bracket member produces a biasing pressure attempting to force the tail parts 7*a* and 7*b* apart from one another. This produces a frictional interlock helping to further secure the tail region of the secondary bracket member with the primary bracket member. Further added to this is the fact that the front tip of the tubular guide 19 presses against the front end clip 9 on the primary bracket member preventing the secondary bracket member from sliding forwardly away from its interlocked position with the secondary bracket member as earlier noted. Therefore the only way to release the two bracket members from one another is by first tipping the front edge or nose of the tubular guide 19 upwardly away from clip 9 of the primary bracket member. This allows the secondary bracket member to then be slid forwardly away from its interlocked position in the tapered slot 15 of the primary bracket member.

When the two bracket members are properly interlocked with one another as shown in FIGS. 1 and 2 the bore through guide 19 aligns directly with the opening 13 in the front clip. The wings on the secondary bracket member seat atop and slightly wrap around the body part 7 of the primary bracket member to further stabilize the interfitting of the two bracket members. The nail or screw is then inserted into the assembly along guide 19 and through the front end clip of the bracket. This traps the interior edge of the evestrough. The mounting member then embeds within the mounting surface to ensure that the secondary bracket member cannot lift upwardly off of the primary bracket member.

It is to be appreciated that if either one of the bracket members does become damaged they are easily released from one another. This is done by first releasing the nail or screw and then reversing the slide in mounting of the secondary bracket member relative to the primary bracket member.

When the bracket is positioned ready to mount to the support surface it will be seen that the screw or nail (as shown in FIG. 1) sits at an upward outward angle relative to the bracket. In this position the outer end of the screw or nail is readily exposed to and easily accessed by a mounting tool such as a wrench or hammer. The rest of the bracket does not interfere with the downward inward mounting of the screw or nail into the mounting surface.

A feature which is further included in the bracket to ease mounting comprises a small indent 20 in the fastening member guide 19. Through the provision of this indent the fastening member can be pushed manually into the guide to the FIG. 1 position where the pressure of the indent on the fastening member holds it with the bracket. The installer can then carry the bracket as the assembled unit of FIG. 1 up to the evestrough without worrying about the nail or screw falling out of the bracket.

Although various preferred embodiments of the present invention have been described in detail, it will be appreciated by those skilled in the art that variations may be made without departing from the spirit of the invention or the scope of the appended claims.

The embodiments of the invention in which an exclusive property or privilege is claimed are defined as follows:

1. An evestrough hanger bracket comprising: a main bracket member having a front end trough engagement clip and a rear end trough engagement clip, said front end clip opening downwardly and said rear end clip opening forwardly toward said front end clip, said front end clip having a fastener member fitting opening therethrough, said bracket further comprising a secondary bracket member which slides into locking engagement with said main bracket member, said secondary bracket member having a tubular bracket member guide which abuts with, and extends rearwardly from said front clip when said secondary bracket member is interlocked with said fastener member fitting main bracket member, said guide of said secondary fastener member presenting an elongated bore which aligns with and terminates at said opening through said front end clip of said main bracket member.

2. An evestrough hanger bracket as claimed in claim 1 wherein said main bracket member includes an elongated slot extending axially thereof, said secondary bracket member including a tail part which fits into said slot, said tail part having opposite side surfaces which are provided with lugs projecting radially of said tail part, said lugs fitting downwardly through said slot and then moving to a position to lock from beneath on said main bracket member as said tail part of said secondary bracket member is fitted into said slot of said main bracket member.

3. An evestrough hanger bracket as claimed in claim 2 wherein said slot has a widened front slot region and tapers inwardly rearwardly to a narrower rear slot region towards said rear end clip of said main bracket member, said lugs of said tail part of said secondary bracket member fitting downwardly through said main bracket member at said widened front slot region with said second bracket member being forced by said front end clip of said main bracket member to slide rearwardly as said tail part of said secondary bracket member fits into said slot of said main bracket member causing said lugs to move towards said narrower rear slot region and lock from beneath against said main bracket member.

4. An evestrough hanger bracket as claimed in claim 2 wherein said secondary bracket member has a one piece construction comprising symmetrical opposite side regions of said secondary bracket member, said side regions being separated by a center region which is folded to form said tubular fastener member guide, the tail parts of said secondary bracket member being formed by said opposite side regions which are side by side and slightly spaced from one another when said secondary bracket member is removed from said main bracket member and which are pressed towards one another as said tail parts are fitted into said slot of said main bracket member.

* * * * *